US008616626B2

(12) United States Patent
Wiecek

(10) Patent No.: US 8,616,626 B2
(45) Date of Patent: Dec. 31, 2013

(54) LINKAGE MECHANISM FOR A HIGH-LEG SEATING UNIT

(75) Inventor: Glenn N. Wiecek, Shelbyville, KY (US)

(73) Assignee: L & P Property Management Company, South Gate, CA (US)

( * ) Notice: Subject to any disclaimer, the term of this patent is extended or adjusted under 35 U.S.C. 154(b) by 317 days.

(21) Appl. No.: 13/047,623

(22) Filed: Mar. 14, 2011

(65) Prior Publication Data

US 2012/0235449 A1 Sep. 20, 2012

(51) Int. Cl.
*A47C 1/02* (2006.01)

(52) U.S. Cl.
USPC ..... 297/84; 297/75; 297/83

(58) Field of Classification Search
USPC ..... 297/75, 83, 84, 86, 423.19
See application file for complete search history.

(56) References Cited

U.S. PATENT DOCUMENTS 3,357,739 A * 12/1967 Knabusch et al. ..... 297/69
3,572,820 A * 3/1971 Ferguson ..... 297/84
3,865,432 A * 2/1975 Rogers et al. ..... 297/316
4,216,991 A * 8/1980 Holobaugh ..... 297/85 R
4,247,146 A 1/1981 Cycowicz
4,863,215 A 9/1989 Crum
5,013,084 A * 5/1991 May ..... 297/85 R
5,374,101 A * 12/1994 Wiecek ..... 297/85 R
5,800,010 A * 9/1998 May ..... 297/85 L
5,992,930 A * 11/1999 LaPointe et al. ..... 297/68
7,396,074 B2 * 7/2008 Wiecek ..... 297/85 L
7,641,277 B2 1/2010 Lawson et al.
2009/0051201 A1 * 2/2009 Wiecek ..... 297/327

OTHER PUBLICATIONS

Notification of Transmittal of the International Search Report and the Written Opinion of the International Searching Authority, or the Declaration, mailed Jun. 7, 2012, in PCT Application No. PCT/US2012/026878; 7 pages.

* cited by examiner

*Primary Examiner* — Philip Gabler
(74) *Attorney, Agent, or Firm* — Shook, Hardy & Bacon L.L.P.

(57) ABSTRACT

Provided is a linkage mechanism for a recliner that includes a seat-mounting plate, a base plate vertically supported by high-legs, a footrest assembly adapted to extend ottoman(s) forward when the recliner is adjusted from a closed to an extended position, and a seat-adjustment assembly. The seat-adjustment assembly includes an ottoman drive link that has a front end pivotably coupled to the footrest assembly and a rear end pivotably coupled to a mid section of a connecting link. The connecting link further includes a front end rotatably coupled to a forward portion of the base plate and a rear end rotatably coupled to a lower end of a rear pivot link. The rear pivot link further includes an upper end that is pivotably coupled to a rearward portion of the seat-mounting plate. The combined operation of three links above locates the seat-adjustment assembly above the base plate's lower edge during adjustment.

17 Claims, 10 Drawing Sheets

LINKAGE MECHANISM FOR A HIGH-LEG SEATING UNIT

BACKGROUND OF THE INVENTION

The present invention relates broadly to motion upholstery furniture designed to support a user's body in an essentially seated disposition. Motion upholstery furniture includes recliners, incliners, sofas, love seats, sectionals, theater seating, traditional chairs, and chairs with a moveable seat portion, such furniture pieces being referred to herein generally as "seating units." More particularly, the present invention relates to an improved linkage mechanism developed to accommodate a wide variety of styling for a seating unit (e.g., high-leg chairs), which is otherwise limited by the configurations of linkage mechanisms in the field.

Many reclining seating units presently exist that allow a user to forwardly extend a footrest and to recline a backrest rearward relative to a seat. These existing seating units typically provide three basic positions: a standard, non-reclined closed position; an extended position; and a reclined position. In the closed position, the seat resides in a generally horizontal orientation and the backrest is disposed substantially upright. Additionally, if the seating unit includes one or more ottomans attached with a mechanical arrangement, the mechanical arrangement is collapsed such that the ottoman(s) are not extended. In the extended position, often referred to as a television ("TV") position, the ottoman(s) are extended forward of the seat, and the backrest remains sufficiently upright to permit comfortable television viewing by an occupant of the seating unit. In the reclined position, the backrest is pivoted rearward from the extended position into an obtuse relationship with the seat for lounging or sleeping.

Yet, in order to provide the adjustment capability described above, these existing reclining seating units require relatively complex linkage mechanisms. The complex linkage mechanisms limit certain design aspects utilized by furniture manufacturers. In one instance, these linkage mechanisms impose constraints on an upholstery designer's use of styling feature (s) on a reclining seating unit. For instance, these linkage mechanisms are bulky and require seating units to incorporate space-saving features (e.g., connecting the linkage mechanisms to a base resting on the floor), thereby hiding the linkage mechanisms below the seat when in the closed position. But, these space-saving features preclude a furniture designer from providing the seating unit with high legs that support a chasses of the seating unit above an underlying surface.

Accordingly, embodiments of the present invention pertain to a novel linkage mechanism that allows a reclining seating unit to provide the three-position adjustment capability in tandem with a high-leg-style design. That is, the linkage mechanism of the present invention is constructed in a simple and compact arrangement in order to provide function without impairing the incorporation of desirable upholstery features.

BRIEF SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Generally, embodiments of the present invention seek to provide a simplified, compact linkage mechanism that can be adapted to essentially any type of seating unit, such as a high-leg style formal chair. As more fully discussed below, embodiments of seating unit include the following components: first and second foot-support ottomans; a leg-support ottoman, a seat; a backrest; a pair of base plates in substantially parallel-spaced relation; a pair of seat-mounting plates in substantially parallel-spaced relation; a seating support surface extending between the seat-mounting plates; and a pair of the generally mirror-image linkage mechanisms that interconnect the base plates to the seat-mounting plates, respectively. Additionally, the seat-mounting plates support the seat via the seating support surface, which is disposed in an inclined orientation in relation to a surface underlying the seating unit. In operation, the linkage mechanisms are adapted to move between the closed position, the extended position, and the reclined position while incrementally increasing the inclined orientation of the seat throughout adjustment.

Typically, the linkage mechanisms include a pair of footrest assemblies that movably interconnect the first and second foot-support ottomans, as well as the leg-support ottoman, to the seat-mounting plates. In operation, the footrest assemblies are adapted to extend and retract the ottomans when adjusting the seating unit between the extended and closed positions, respectively. Advantageously, during operation, the set of linkages comprising the footrest assembly are adapted to collapse to the closed position such that each member of the set of linkages is located below the seating support surface, yet above crossbar(s) affixed to the lower edge of the base plates. This collapsed configuration of the footrest assembly reduces the set of linkages to a compact size such that the seating unit can incorporate high legs (e.g., legs of a traditional chair) while still hiding the footrest when adjusted to the closed position.

In addition, the linkage mechanisms each include a seat-adjustment assembly. This assembly functions to translate a respective seat-mounting plate over a respective base plate during adjustment of the seating unit. In an exemplary embodiment, the seat-adjustment assembly includes, at least, an ottoman drive link, a connecting link, a rear pivot link, a front bellcrank, and a support link. The ottoman drive link includes a front end and a rear end. Typically, the front end of the ottoman drive link is pivotably coupled to the footrest assembly. The connecting link includes a front end, a mid section, and a rear end. In embodiments, the mid section of the connecting link is pivotably coupled to the rear end of the ottoman drive link, while the front end of the connecting link is rotatably coupled to a forward portion of a respective base plate. The rear pivot link includes an upper end, a mid section, and a lower end. Generally, the upper end of the rear pivot link is pivotably coupled to a rearward portion of a respective seat-mounting plate, while the lower end of the rear pivot link is rotatably coupled to the rear end of the connecting link. The front bellcrank includes an upper end, a mid section, and a lower end. Typically, the upper end of the front bellcrank is rotatably coupled to a forward portion of a respective seat-mounting plate. Last, the support link includes a front end, a mid section, and a rear end. In an exemplary embodiment, the rear end of the support link is pivotably coupled to a rearward portion of a respective base plate, while the front end of the support link is pivotably coupled to the mid section of the front bellcrank.

During adjustment between closed, extended, and reclined positions, the seat-adjustment assembly serves to tilt the seating support surface at particular inclination angles and to incline or recline the backrest. In addition, the interconnections of the links comprising the seat-adjustment assembly maintain the linkage mechanism in a compact configuration that may be hidden between arms, or within a chassis, of the seating unit. In this way, the seating unit may be accommodated with high-legs or other furniture-design elements, which are precluded from being incorporated into conventional recliner-style seating units due to the bulky nature of conventional linkage mechanisms.

BRIEF DESCRIPTION OF THE SEVERAL VIEWS OF THE DRAWING

In the accompanying drawings which form a part of the specification and which are to be read in conjunction therewith, and in which like reference numerals are used to indicate like parts in the various views.

DETAILED DESCRIPTION OF THE INVENTION

Figure 1:
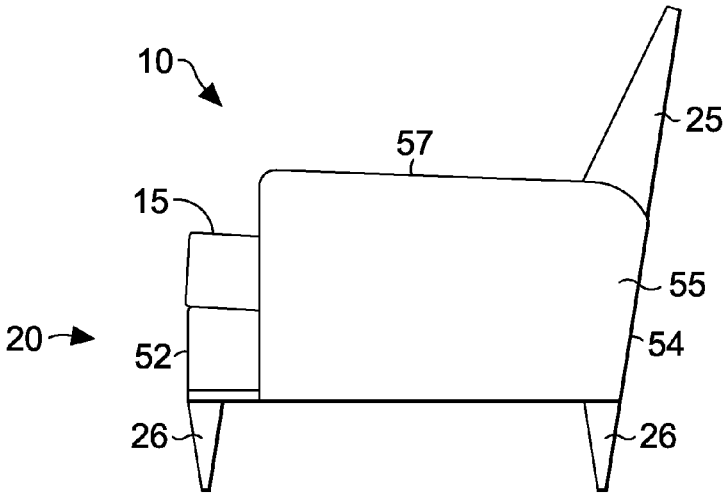
FIG. 1 is a diagrammatic lateral view of a recliner seating unit in a closed position, in accordance with an embodiment of the present invention.
Figure 2:
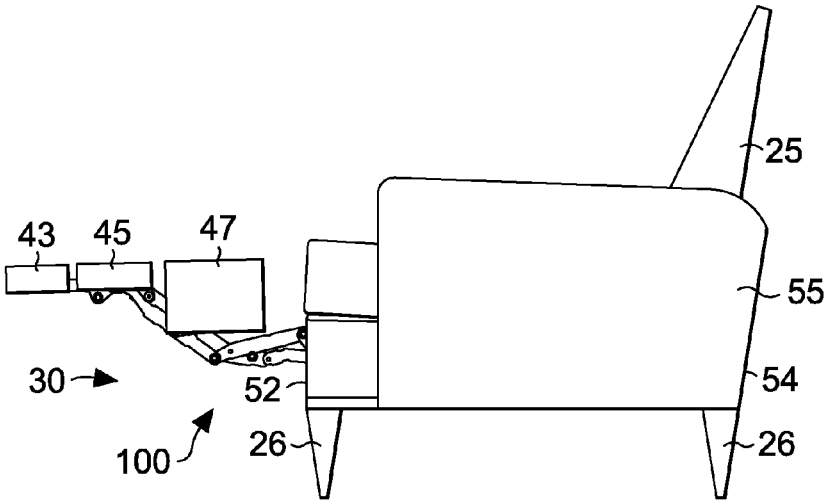
FIG. 2 is a view similar to FIG. 1, but in an extended position, in accordance with an embodiment of the present invention.
Figure 3:
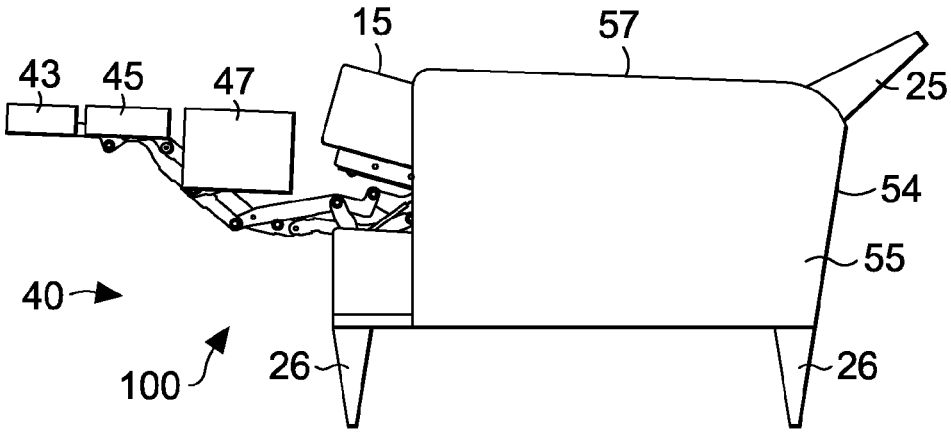
FIG. 3 is a view similar to FIG. 1, but in a reclined position, in accordance with an embodiment of the present invention.

FIGS. 1-3 illustrate a seating unit 10. Seating unit 10 has a seat 15, a backrest 25, legs 26, a linkage mechanism 100, a first foot-support ottoman 43, a second foot-support ottoman 45, a leg-support ottoman 47, and a pair of opposed arms 55. Opposed arms 55 are laterally spaced and have an arm-support surface 57 that is substantially horizontal. The opposed arms 55 are supported by the legs 26, which raise it above an underlying surface (not shown). In addition, in the context of a frame-within-a-frame style chair, the opposed arms 55 are stationary with respect to the seat 15, wherein the seat is adjustable via the linkage mechanism 100 that is generally disposed between the opposed arms 55 (i.e., located substantially above lower edges of the opposed arms 55). In this embodiment, the seat 15 is moveable between the opposed arms 55 during adjustment of the seating unit 10. Typically, the seat 15 is moveable according to the arrangement of the linkage mechanism 100 such that no portion of the seat 15 interferes with the opposed arms 55 throughout adjustment.

With respect to a pivot-over-arm style chair, not shown in the figures, the opposed arms 55 are actually interconnected with the seat 15. Further, in this embodiments, the legs 26 do not support the opposed arms 55. Instead, the legs 26 support an underlying frame of the seating unit 10, such that the seat 15 is movable together with the opposed arms 55.

In one embodiment, the backrest 25 extends from a rearward section 54 of the seating unit 10 and is rotatably coupled to the linkage mechanism 100, typically proximate to the arm-support surface 57. The first foot-support ottoman 43, the second foot-support ottoman 45, and the leg-support ottoman 47 are moveably supported by a footrest assembly within the linkage mechanism 100. In embodiments, the linkage mechanism 100 is arranged to articulably actuate and control movement of the seat 15, the backrest 25, and the ottomans 43, 45, and 47 between the positions shown in FIGS. 1-3, as more fully described below.

As shown in FIGS. 1-3, the seating unit 10 is adjustable between three basic positions: a closed position 20, an extended position 30 (i.e., TV position), and a reclined position 40. FIG. 1 depicts the seating unit 10 adjusted to the closed position 20, which is a normal non-reclined sitting position with the seat 15 residing in a generally horizontal position and the backrest 25 generally upright and in a substantial perpendicular relationship with the seat 15. In a particular configuration, the seat 15 may be disposed in a slightly inclined orientation relative to the arm-support surface 57. In one embodiment, the inclined orientation may be maintained throughout adjustment of the seating unit 10. In another embodiment, the linkage mechanism 100 is configured to incrementally increase the inclined orientation of the seat 15 during adjustment of the seating unit 10 from the closed position 20, to the extended position 30, and then to the reclined position 40.

In addition, when adjusted to the closed position 20, the ottomans 43, 45, and 47, as well as the linkage mechanism 100 are positioned below the seat 15; however, the linkage mechanism 100 does not visibly extend below the opposed arms 55. In this way, the compact design of the linkage mechanism 100 allows for hiding the entirety of the linkage mechanism 100 between a lower edge of the arms 55, or crossbars spanning a chassis, and a lower surface of the seat 15 when the seating unit 10 is adjusted to the closed position 20.

Turning to FIG. 2, the extended position 30, or TV position, will now be described. When the seating unit 10 is adjusted to the extended position 30, the first foot-support ottoman 43, the second foot-support ottoman 45, and the leg-support ottoman 47 are extended forward of a forward section 52 of the seating unit 10 and disposed generally horizontal. The backrest 25 continues to reside in a substantially perpendicular relationship to the seat 15. Also, the seat 15 is maintained in an inclined orientation relative to the arm-support surface 57. Thus, the configuration of the seating unit 10 in the extended position 30 provides a reclined TV position while providing space-saving utility that continues to hide a majority of the linkage mechanism 100 (besides the extended footrest assembly) behind the arms 55. Further, with respect to a frame-within-a-frame style chair, the seat 15 is translated slightly rearward and downward relative to the opposed arms 55. Alternatively, in a pivot-over-arm style chair, the opposed arms 55 shift slightly forward with the seat 15. Accordingly, both styles mentioned above have substantially similar seat movement. This movement of the seat 15 allows for a variety of styling to be incorporated into the seat 15, such as high-legs in a formal chair.

FIG. 3 depicts the reclined position 40, in which the seating unit 10 is fully reclined. As discussed above, the legs 26 may extend downward from the opposed arms 55, thereby maintaining the arm-support surface 57 of the opposed arms 55 in a consistent position and orientation during adjustment of the seating unit 10. In contrast, during adjustment to the reclined position 40, the backrest 25 is rotated rearward by the linkage mechanism 100 and biased in a rearward inclination angle, while the ottomans 43, 45, and 47 may be moved farther forward and upward from their position in the extended position 30.

The rearward inclination angle of the backrest 25, upon adjustment to the reclined position 40, is typically an obtuse angle in relation to the seat 15. However, the rearward inclination angle of the backrest 25 is typically accompanied by an upward translation of the seat 15 as controlled by the linkage mechanism 100. This combination of movements is distinct from the operation of conventional reclining chairs that are equipped with three-position mechanisms.

Figure 4:
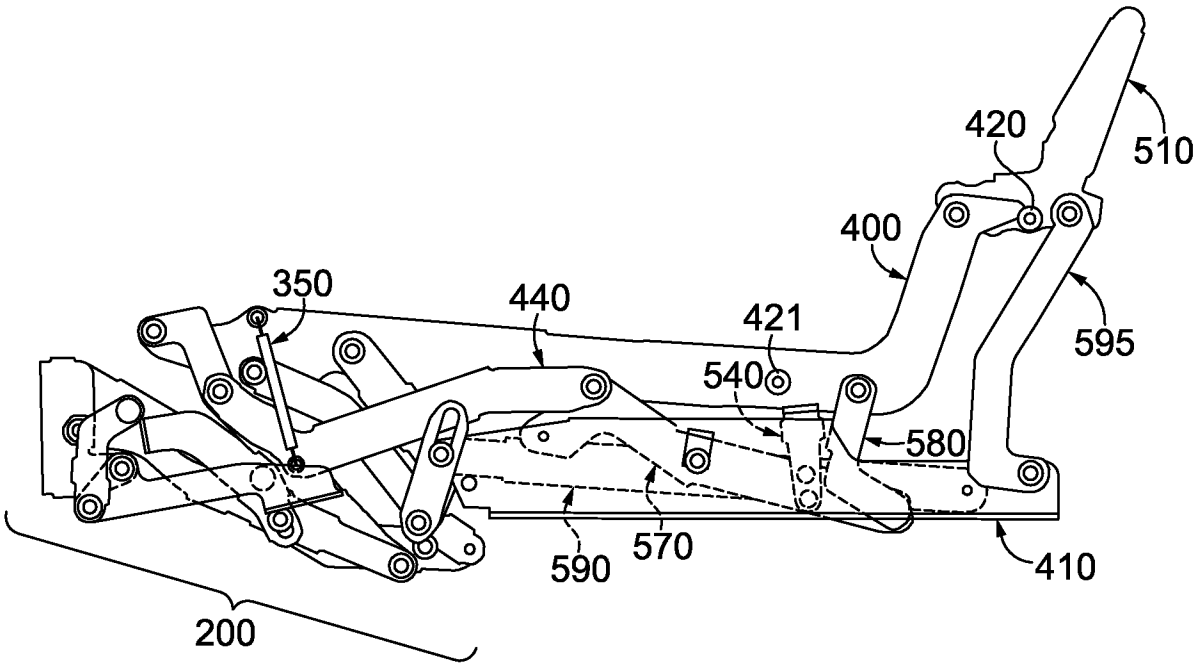
FIG. 4 is a diagrammatic lateral view of a linkage mechanism in the closed position from a vantage point internal to the recliner seating unit, in accordance with an embodiment of the present invention.
Figure 6:
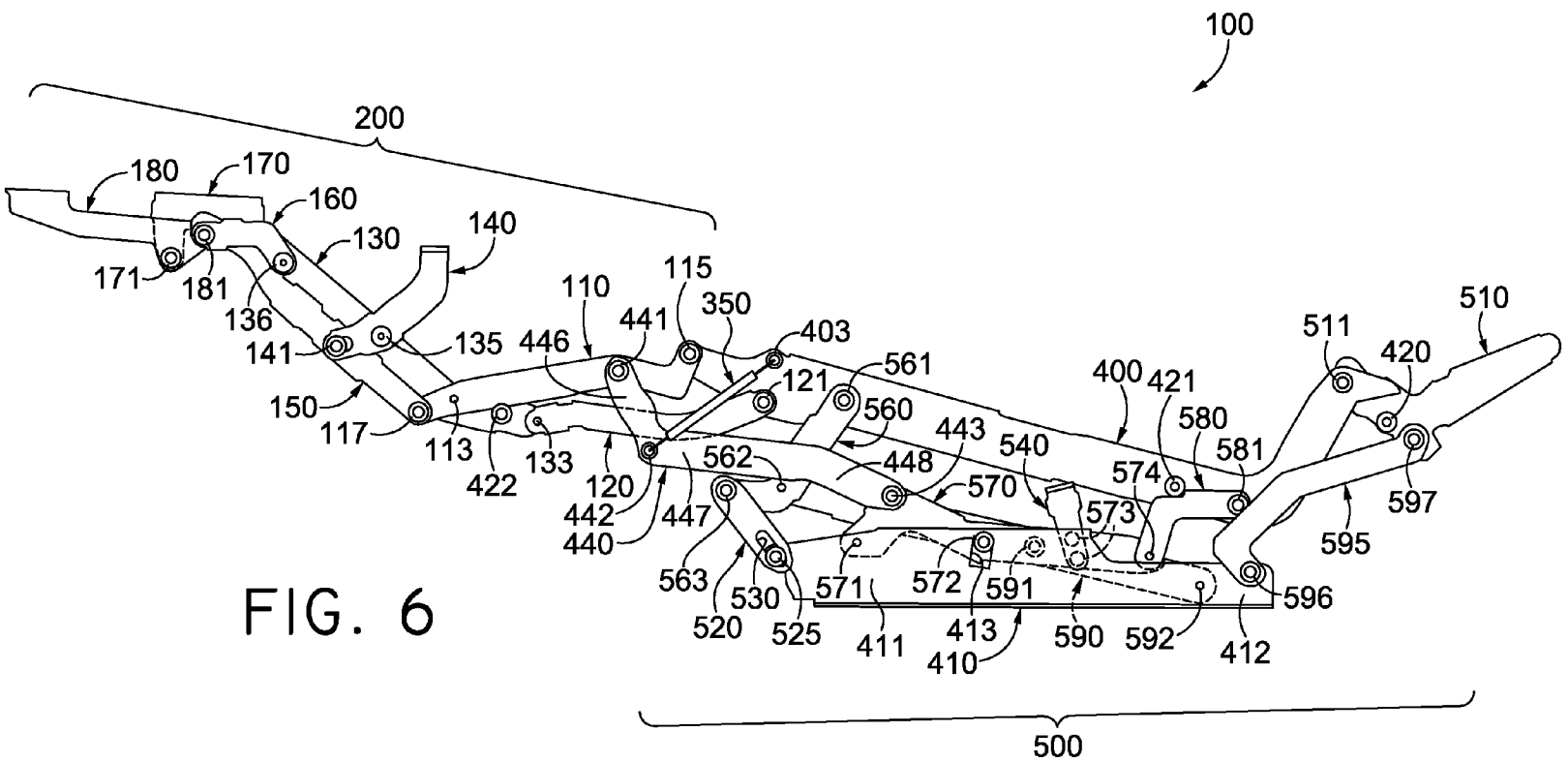
FIG. 6 is a view similar to FIG. 4, but illustrating the linkage mechanism in the reclined position, in accordance with an embodiment of the present invention.
Figure 7:
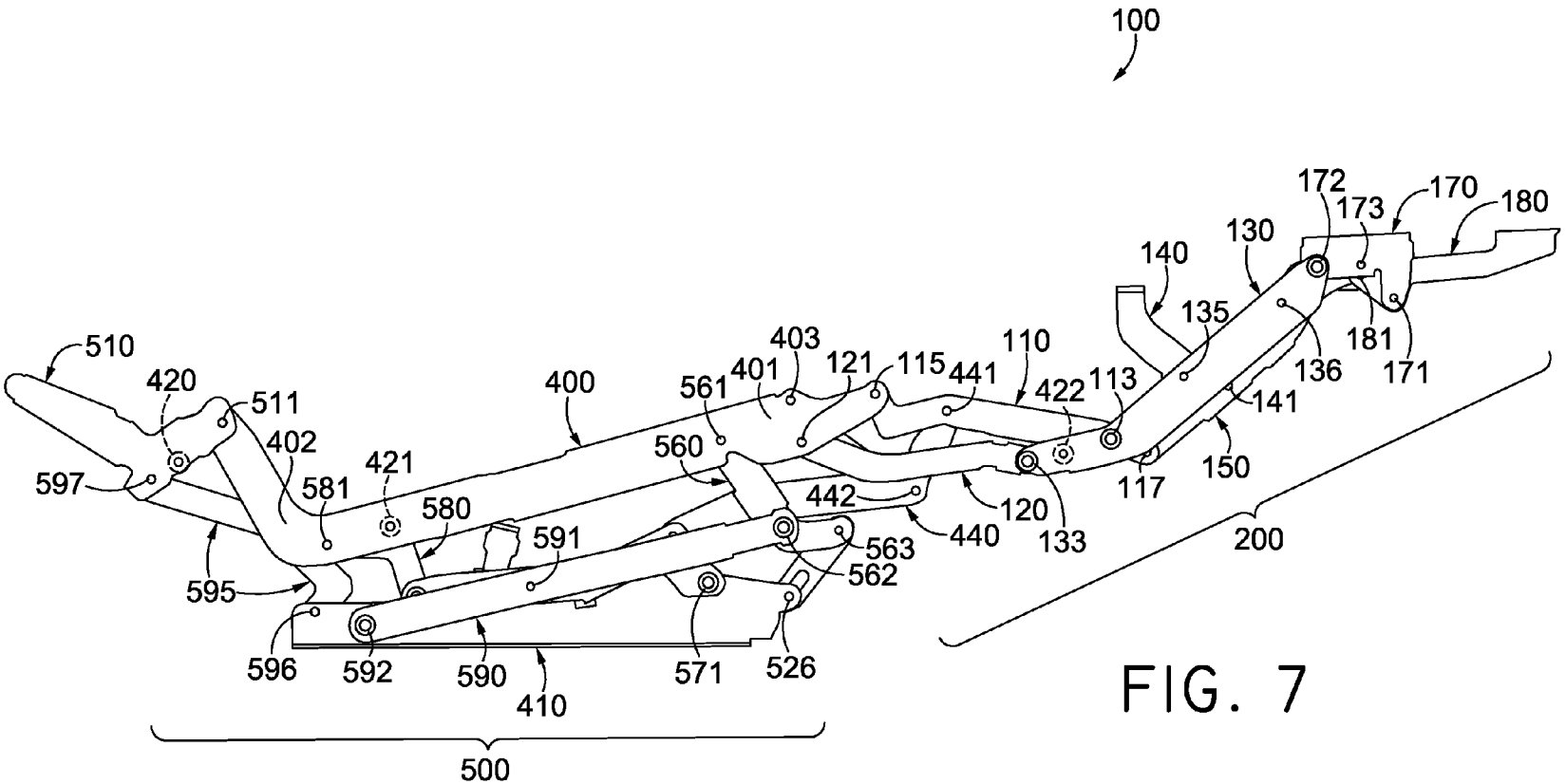
FIG. 7 is a diagrammatic lateral view of the linkage mechanism in the reclined position from a vantage point external to the recliner seating unit, in accordance with an embodiment of the present invention.
Figure 8:
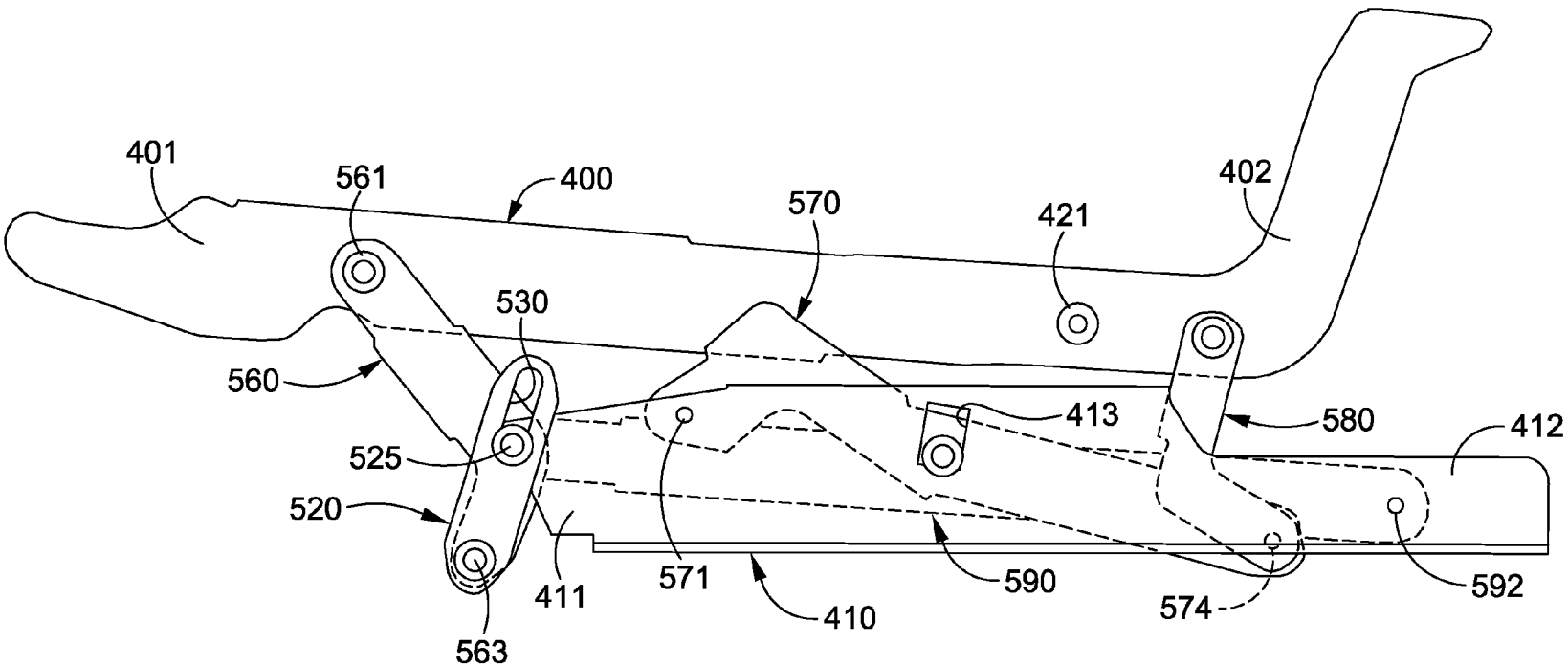
FIG. 8 is a partial side-elevation view of the linkage mechanism in the closed position highlighting a seat-adjustment assembly, in accordance with an embodiment of the present invention.

FIGS. 4-10 illustrate the configuration of the linkage mechanism 100 for a manually or automatically adjustable, three-position recliner seating unit (hereinafter the "seating unit") that, in embodiments, is designed to be configured as to a high-leg style seating unit 10. As discussed above, the linkage mechanism 100 is arranged to articulably actuate and control movement of a seat, a backrest, and ottoman(s) of the seating unit between the positions shown in FIGS. 4-10. That is, the linkage mechanism 100 is adjustable to a reclined position (FIGS. 6, 7, and 10), an extended (TV) position (FIGS. 5 and 9), and a closed position (FIGS. 4 and 8). In the reclined position, as mentioned above, the backrest is rotated rearward and biased in a rearward inclination angle, which is an obtuse angle in relation to the seat. When the seating unit is adjusted to the extended position, the ottoman(s) remain extended forward, while the backrest is angularly biased substantially perpendicular to the seat. The closed position is configured as a non-reclined sitting position with the seat in a generally horizontal position, or with a slight incline, and the backrest remaining generally upright. During adjustment between the closed, extended, and reclined positions, the linkage mechanism 100 employs a seat-adjustment assembly 500 with an ottoman drive link 440, a connecting link 570, and a rear pivot link 580 that operate in concert to adjust an angular bias and translate a pair of seat-mounting plates 400 in relation to respective base plates 410. The geometry of the ottoman drive link 440, the connecting link 570, and the rear pivot link 580, as well as the locations of their interconnections, enable the advantages of greater extension of a footrest assembly 200 and improved occupant control (i.e., back balance) when adjusting the seating unit to the reclined position. That is, the configuration of the seat-adjustment assembly 500 lends itself to easier operation when the occupant leans rearward against the backrest (exerting rearward directional force on a back-mounting link 510) or sits forward to adjust the seating unit to the extended position.

Generally, the linkage mechanism 100 comprises a plurality of linkages that are arranged to actuate and control movement of the seating unit during movement between the closed, the extended, and the reclined positions. Typically, in order to accomplish articulated actuation of the linkage mechanism 100, the linkages may be pivotably coupled to one or more other linkages or plates comprising the linkage mechanism 100. It is understood and appreciated that the pivotable couplings (illustrated as pivot points in the figures) between these linkages can take a variety of configurations, such as pivot pins, bearings, traditional mounting hardware, rivets, bolt and nut combinations, or any other suitable fasteners which are well-known in the furniture-manufacturing industry. Further, the shapes of the linkages and the brackets may vary, as may the locations of certain pivot points. It will be understood that when a linkage is referred to as being pivotably "coupled" to, "interconnected" with, "attached" on, etc., another element (e.g., linkage, bracket, frame, and the like), it is contemplated that the linkage and elements may be in direct contact with each other, or other elements, such as intervening elements, may also be present.

In operation, the linkage mechanism 100 guides the rotational movement of the backrest, the seat, and the ottoman(s). In an exemplary configuration, these movements are controlled by a pair of essentially minor-image linkage mechanisms (one of which is shown herein and indicated by reference numeral 100), which comprise an arrangement of pivotably interconnected linkages. The linkage mechanisms are disposed in opposing-facing relation about a longitudinally-extending plane that bisects the seating unit between the pair of opposed arms. As such, the ensuing discussion will focus on only one of the linkage mechanisms 100, with the content being equally applied to the other complimentary linkage assembly.

Figure 5:
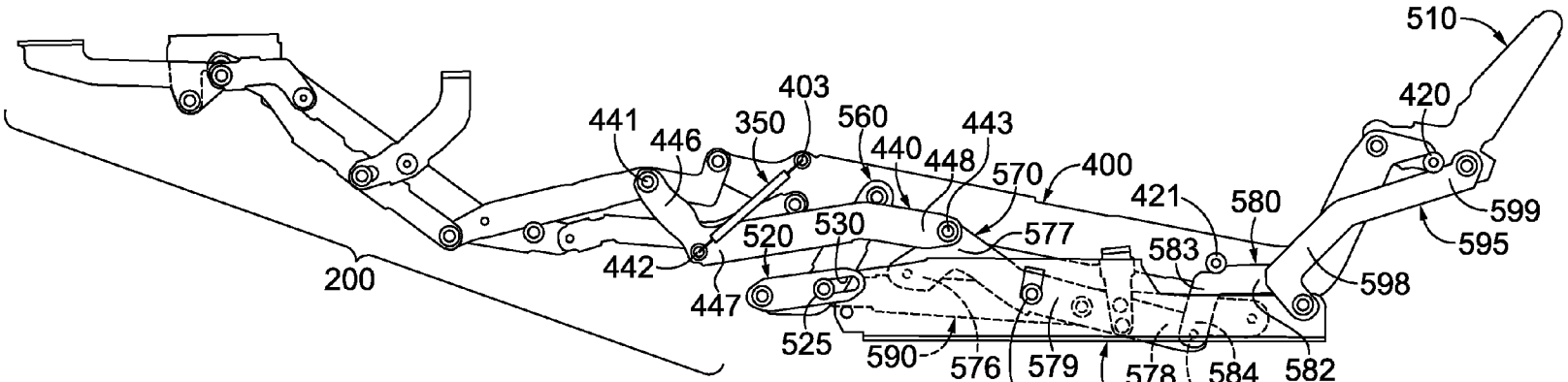
FIG. 5 is a view similar to FIG. 4, but illustrating the linkage mechanism in the extended position, in accordance with an embodiment of the present invention.

With reference to FIGS. 4-6, diagrammatic lateral views of the linkage mechanism 100, from a vantage point internal to the seating unit, are shown, in accordance with embodiments of the present invention. In one embodiment, the linkage mechanism 100 includes the footrest assembly 200, the seat-mounting plate 400, the base plate 410, and the seat-adjustment assembly 500. Footrest assembly 200 is comprised of a plurality of links arranged to extend and collapse the ottoman (s) during adjustment of the seating unit between the extended position and the closed position, respectively. Seat-mounting plate 400 is configured to fixedly mount to the seat and, in conjunction with an opposed seat-mounting plate, define a seat support surface (not shown). Seat-adjustment assembly 500 includes the back-mounting link 510, the links 440, 570, and 580, and a plurality of other links. Generally, the seat-adjustment assembly 500 is adapted to recline and incline the backrest, which is coupled to the back-mounting link 510. In addition, the seat-adjustment assembly 500 is adapted to laterally translate and angularly adjust the seat, which is coupled to the seat-mounting plate 400. Further, in automated embodiments of the seating unit, the seat-adjustment assembly 500 is coupled to crossbar(s) that are adjusted linearly or rotationally by a linear actuator (e.g., motor mechanism), thereby facilitating movement of the seating unit in response to user-initiated electronic actuation.

In embodiments, one or more legs are adapted to vertically raise and support the seating unit above an underlying surface. In embodiments, the leg(s) (see reference numeral 26 of FIGS. 1-3) are mounted to the arms in the frame-within-a-frame style chair, while the leg(s) are mounted to an underlying arm base (not shown) in the pivot-over-arm style chair. Often, a chassis is mounted to either the arm or the underlying arm base. The base plate 410 is mounted to tube(s) (e.g., both front and rear) spanning the chassis. The seat-mounting plate 400 is interconnected to the base plate 410 via links comprising the seat-adjustment assembly 500, which translate the seat over the base plate 410 during adjustment between the closed, extended, and reclined positions while incrementally adjusting the angle of inclination therebetween.

The footrest assembly 200 includes a front ottoman link 110, a rear ottoman link 120, an outer ottoman link 130, a mid-ottoman bracket 140, an inner ottoman link 150, an extension link 160, a footrest bracket 170, and a footrest link 180. Referring to FIGS. 6 and 7, the front ottoman link 110 is rotatably coupled to a forward portion 401 of the seat-mounting plate 400 at pivot 115. The front ottoman link 110 is pivotably coupled to the outer ottoman link 130 at pivot 113 and a lower end the inner ottoman link 150 at pivot 117. Further, the front ottoman link 110 is pivotably coupled to a front end 446 of the ottoman drive link 440 at pivot 441, where the ottoman drive link 440 acts to extend and retract the footrest assembly as discussed more fully below.

The rear ottoman link 120 is rotatably coupled to the forward portion 401 of the seat-mounting plate 400 at pivot 121 and is pivotably coupled to a lower end of the outer ottoman link 130 at pivot 133. In an exemplary embodiment, the pivot 121 of the rear ottoman link 120 is located rearward in relation to the pivot 115 of the front ottoman link 110. The outer ottoman link 130 includes the lower end pivotably coupled to the rear ottoman link 120 at the pivot 133, and a mid portion pivotably coupled to the front ottoman link 110 at the pivot 113 and to the mid-ottoman bracket 140 at pivot 135. Further, the outer ottoman link 130 includes an upper end pivotably coupled to the extension link 160 at pivot 136 and to the footrest bracket 170 at pivot 172 (see FIG. 7). Even further, the outer ottoman link 130 includes a front stop element 422 for retaining extension of the footrest assembly 200. In operation, the front stop element 422 contacts an edge of the front ottoman link 110 when the linkage mechanism 100 is adjusted to the extended position, thereby resisting further extension of the footrest assembly 200. The mid-ottoman bracket 140 includes a straight end pivotably coupled to the mid portion of the outer ottoman link 130 at the pivot 135 and to a mid portion of the inner ottoman link 150 at pivot 141. In addition, the mid-ottoman bracket 140 includes an angled end that is typically connected to the leg-support ottoman (see reference numeral 47 of FIG. 2).

With continued reference to FIGS. 6 and 7, the inner ottoman link 150 includes the lower end pivotably coupled to the front ottoman link 110 at the pivot 117, the mid portion pivotably coupled to the mid-ottoman bracket 140 at the pivot 141, and an upper end pivotably coupled to the footrest bracket 170 at pivot 173. The extension link 160 includes the lower end pivotably coupled to the outer ottoman link 130 at the pivot 136 and a rearward portion of the footrest link 180 at pivot 181. The footrest bracket 170 includes one end rotatably coupled to the upper end of the outer ottoman link 130 at the pivot 172 and to the upper end of the inner ottoman link 150 at the pivot 173. Further, the footrest bracket 170 is pivotably coupled to the rearward portion of the footrest link 180 at pivot 171. Typically, the footrest bracket 170 is also connected to the second foot-support ottoman (see reference numeral 45 of FIG. 2).

Generally, the footrest link 180 includes a forward portion and the rearward portion, which is pivotably coupled to the footrest bracket 170 at the pivot 171 and to the extension link 160 at the pivot 181. The forward portion of the footrest link 180 is connected to the first foot-support ottoman (see reference numeral 43 of FIG. 2). In an exemplary embodiment, the first and second foot-support ottomans are disposed in generally horizontal orientations when in the extended position and the reclined position.

In an exemplary embodiment, as discussed above, the front ottoman link 110 of the footrest assembly 200 is pivotably coupled to the front end 446 of the ottoman drive link 440 at the pivot 441. In a manual-actuation embodiment of the linkage mechanism 100, which does not include a linear actuator and relies on a manual actuation by an occupant of the seating unit (e.g., with the aid of tension device 350) to initiate adjustment, an adjustment handle (not shown) may be employed to invoke extension of the footrest assembly 200 from the closed position to the extended position. In instances of the present invention, the adjustment handle may extend generally upward from the seat-adjustment assembly 500 and may be configured to receive a manual actuation from an occupant of the seating unit when attempting to adjust the linkage mechanism 100 from the closed position (see FIG. 4) to the extended position (see FIG. 5). In operation, the occupant's manual actuation at the adjustment handle portion may be a rearward force that causes a lower contact edge of the adjustment handle to push forward a upon a release stop element, which is directly or indirectly coupled to the ottoman drive link 440. This forward push, in turn, propels the ottoman drive link 440 forward, thereby applying a linear force upon the front ottoman link 110 at the pivot 441. This linear force, in cooperation with a backward translation of the seat-mounting plate 400 with respect to the base plate 410, initiates the extension of the footrest assembly 200 from the closed to the extended position. The backward translation of the seat-mounting plate is expedited by the tension device 350 (e.g., helical spring extending between pivot 442 on the ottoman drive link 440 and pivot 403 on the forward portion 401 of the seat-mounting plate 400) and/or by the occupants weight in the seating unit.

In embodiments, the linear force directed through the ottoman drive link 440 acts on the pivot 441 such that the front ottoman link 110 is rotated forward about the pivot 115 causing the footrest assembly 200 to extend. The forward rotation of the front ottoman link 110 prompts forward rotation of the rear ottoman link 120 about the pivot 121. Generally, as a result of the configuration of the pivots 133 and 113, the front ottoman link 110 and the rear ottoman link 120 rotate in substantial parallel-spaced relation. The rotation of the front ottoman link 110 and the rear ottoman link 120 generate upward movement of the inner ottoman link 150 and the outer ottoman link 130, respectively.

During their upward movements, the inner and outer ottoman links 150 and 130 operate in conjunction to raise and rotate the mid-ottoman bracket 140, the footrest bracket 170, and the footrest link 180 to generally horizontal orientations. Full extension of the footrest assembly 200 may be accomplished by the weight of the occupant acting upon a seat of the seating unit in concert with a longitudinal tension generated by the tension device 350. As a result of adjustment to the extended position, the first foot-support ottoman 43 (supported by the footrest link 180), the second foot-support ottoman 45 (supported by the footrest bracket 170), and the leg-support ottoman 47 (supported by the mid-ottoman bracket 140) are movable from positions below the seat support surface to extended, horizontally-orientated positions. In an exemplary embodiment, the configuration of the ottoman drive link 440 and the locations of its inter-coupling between the front ottoman link 110 of the footrest assembly 200 and the connecting link 570 of the seat-adjustment assembly 500 achieve increased forward extension of the footrest assembly 200 than conventional recliners.

As illustrated in FIGS. 4-7, the tension device 350 spans between a first anchor connection (pivot 442) at a mid portion 447 of the ottoman drive link 440 and a second anchor connection (pivot 403) at the forward portion 401 of the seat-mounting plate 400. Functionally, the locations of the pivots 442 and 403 that anchor opposed ends of the tension device 350 assist the tension device 350 in serving two functions once tension is generated therein. First, the tension device 350 acts to provide upward support to the footrest assembly 200 when extended to the extended position, thereby preventing the collapse of the footrest assembly 200 upon the weight of the occupant's legs being applied thereto. Second the tension device 350 acts to sequence movements of the seating unit. That is, the tension device 350 resists movement of the back-mounting link 510 to the reclined position upon shifting the seating unit to the extended position, thus, providing defined sequencing between the extended and reclined positions.

It will be appreciated and understood that, besides providing the adjustment handle to receive direct manual actuation, various other configurations are contemplated that allow an occupant to manually trigger actuation of the footrest assembly 200. For instance, an adaptation of the adjustment handle to receive a cable is contemplated by embodiments of the instant invention, where the cable is manipulated by a release level of a cable-actuation mechanism assembled to the seating unit. Further, automated-actuation embodiments of the linkage mechanism 100 and employ the linear actuator are contemplated by the present invention. For instance, an activator bar that extends between the opposed linkage mechanism 100 and is connected at opposed ends to respective seat-mounting plates 400 may be provided. In operation, linear-actuator-generated movement of the activator bar in a first phase causes forward translation of the ottoman drive link 440 with respect to the seat-mounting plate 400. This forward translation creates a forward push (directional force) on the front ottoman link 110 via the pivot 441, which is transferred into an upward and forward rotation of the front ottoman link 110. The rotation initiates extension of the footrest assembly 200 from the closed position to the extended position. In a second phase of adjustment of the seating unit, linear-actuator-generated movement of the activator bar raises the seat-mounting plate 400 with respect to the base plate 410, causing the back-mounting link 510 to recline to the reclined position.

Retraction of the footrest assembly 200 may be manually triggered or automatically controlled. In embodiments that employ the adjustment handle, retraction of the footrest assembly 200 may be invoked by the occupant of the seating unit applying a downward force on one or more of the ottomans 43, 45, and 47. Upon the downward force overcoming the resistance of the tension device 350, the ottoman drive link 440 is moved in a downward and rearward translation. Generally, this downward and rearward translation coincides with movement of the footrest assembly 200 that is reverse to the steps discussed above with reference to the extension operation.

As discussed above, the front ottoman link 110 of the footrest assembly 200 is pivotably coupled to the ottoman drive link 440 at the pivot 441. Accordingly, the upward and forward directional force applied to extend the footrest assembly 200 is directed to the front ottoman link 110 at the pivot 441, as opposed to the rear ottoman link 120. Thus, the configurations of the footrest assembly 200 illustrated in FIGS. 4-7, unlike traditional four-bar extension mechanisms, promote significant extension of the ottoman(s) while enabling a compact collapsed size of the footrest assembly 200 when in the closed position. This compact collapsed size allows the footrest assembly 200 to be located below the seating support surface and above a lower surface of at least one crossbeam (e.g., chassis tube) when in the closed position. By folding into this compact collapsed size, the footrest assembly 200 is hidden between the arms, or wall-sections of the chassis, of the seating unit. As such, a furniture designer can supply the seating unit with high legs, so that the seating unit resembles a traditional-chair-type seating unit, or can lower the chassis of the seating unit to the underlying surface without creating an interference when adjusting the footrest assembly 200. Because the footrest assembly 200 is hidden in the closed position, these aesthetically pleasing configurations of a fully operational seating unit are possible.

Figure 9:
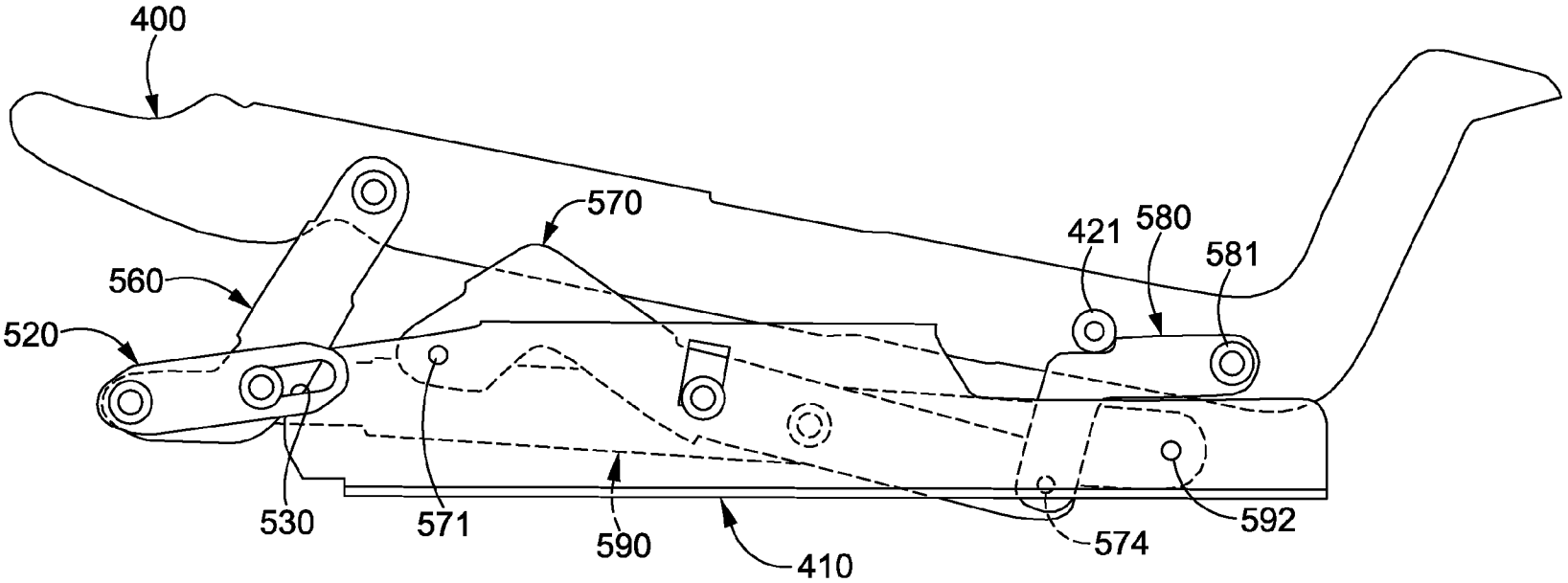
FIG. 9 is a view similar to FIG. 8, but in the extended position, in accordance with an embodiment of the present invention.
Figure 10:
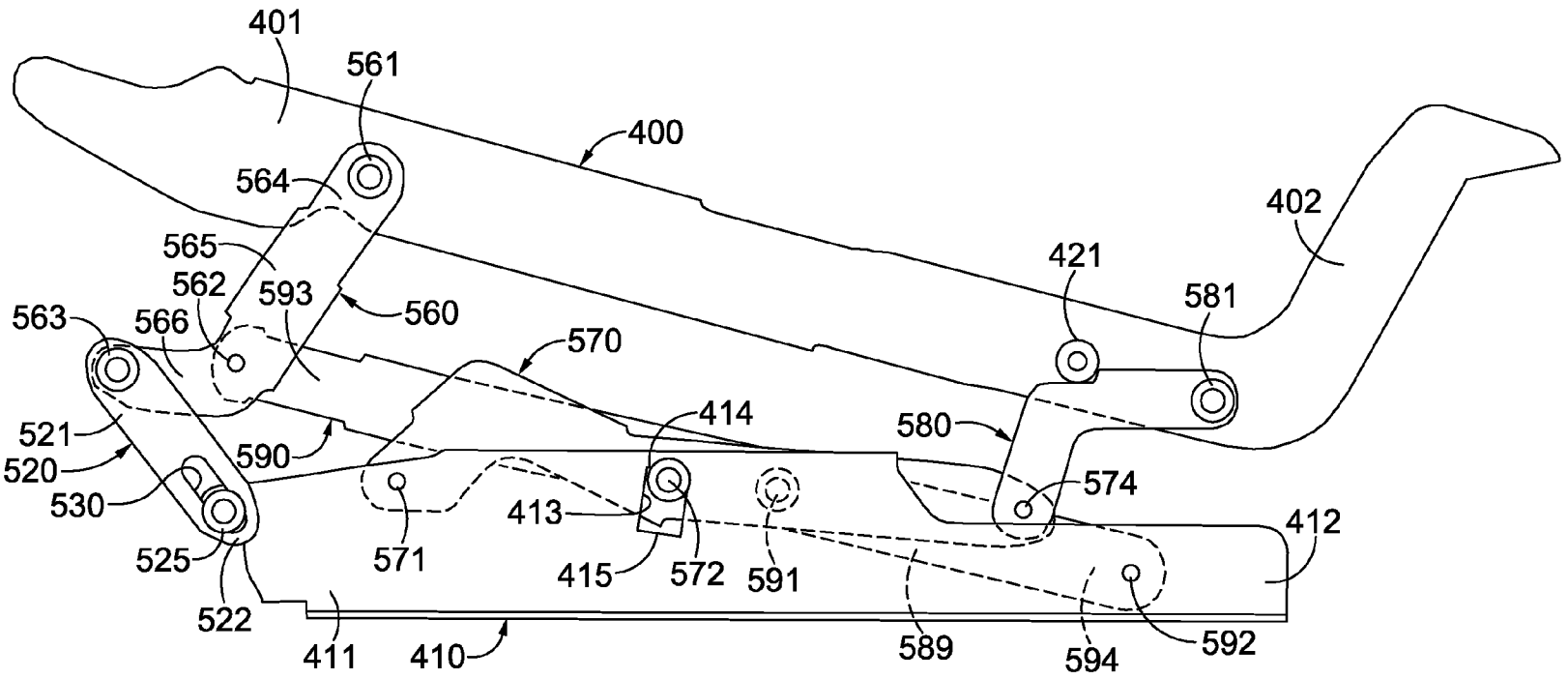
FIG. 10 is a view similar to FIG. 8, but in the reclined position, in accordance with an embodiment of the present invention.

With reference to FIGS. 7-10, the seat-adjustment assembly 500 will now be discussed in accordance with embodiments of the present invention. Generally, the seat-adjustment assembly 500 provides for upward translation of the seat-mounting plate 400 with respect to the base plate 410 during adjustment of the seating unit between the extended and reclined positions. The seat-adjustment assembly 500 includes the back-mounting link 510, a sequence link 520, a stabilizer member 540, a front bellcrank 560, a connecting link 570, the rear pivot link 580, the support link 590, and a back control link 595. Initially, as illustrated in FIG. 10, the front bellcrank 560 is rotatably coupled at its upper end 564 to the forward portion 401 of the seat-mounting plate 400 at pivot 561. Also, a mid section 565 of the front bellcrank 560 is pivotably coupled to a front end 593 of the support link 590 at pivot 562. Further, a lower end 566 of the front bellcrank 560 is rotatably coupled to a first end 521 of the sequence link 520 at pivot 563. The support link 590 includes the front end 593 and a rear end 594. The front end 593 of the support link 590 is pivotably coupled to the front bellcrank 560 at the pivot 562, while the rear end 594 of the support link 590 is pivotably coupled to a rearward portion 412 (see FIG. 6) of the base plate 410 at pivot 592. As illustrated in the FIGS. 8-10, the coupling between the front bellcrank 560, the support link 590, and the sequence link 520 is adapted to incrementally increase the inclined relationship between the seat-mounting plate 400 and the base plate 410 as the seating unit progressively adjusts from the closed position, to the extended position, and then to the reclined position.

As best depicted in FIG. 5, the connecting link 570 includes a front end 576, an upper section 577 a mid section 579, and a rear end 578. The front end 576 of the connecting link 570 is pivotably coupled to a forward portion 411 of the base plate 410. The mid section 579 of the connecting link 570 is slidably coupled to the base plate 410 at an aperture 413. In an exemplary embodiment, the slidable coupling comprises a second stop element 572 fixedly attached to the mid section of the connecting link 570, where the second stop element 572 extends through the aperture 413 formed within the base plate 410. In operation, the second stop element 572 moves upward within the aperture 413 when adjusting the seating unit to the reclined position and contacts an upper edge 414 of the aperture 413. Alternatively, the second stop element 572 moves downward within the aperture 413 when adjusting the seating unit to the extended position and contacts a lower edge 415 of the aperture 413. In this way, the geometry of the aperture 413 (i.e., shape of the edges in the aperture 413) restricts the movement of the mid section 579 of the connecting link 570 to a substantial vertical path, while imposing upper and lower limits on the vertical path of movement.

The upper section 577 of the connecting link 570 is further pivotably coupled to a mid section 589 of the support link 590 at pivot 591. The rear end 578 of the connecting link 570 is rotatably coupled to the rear pivot link 580 at pivot 574. In embodiments, the stabilizer member 540 is fixedly attached to the connecting link 570 at connection point(s) 573. These connection point(s) 573 may be made by any fasteners known in the relevant field of industry. Generally, the stabilizer member 540 is orientated in a substantially vertical configuration such that an upper portion of the stabilizer member 540 contacts a lower edge of the seat-mounting plate 400 at one or more positions during adjustment of the seating unit, such as the reclined position as shown in FIGS. 6 and 7.

With reference to FIG. 5, the rear pivot link 580 includes an upper end 582, a mid section 583, and a lower end 584. The upper end 582 of the rear pivot link 580 is pivotably coupled to the rearward portion 402 of the seat-mounting plate 400 at pivot 581, while the lower end 584 of the rear pivot link 580 is rotatably coupled to the rear end 578 of the connecting link 570 at the pivot 574. The rearward portion 402 of the seat-mounting plate 400 includes a first stop element 421 fixedly attached thereto. In operation, an edge of the mid section 583 of the rear pivot link 580 contacts the first stop element 421 when the seating unit is adjusted to the extended position and is held in contact upon adjustment to the reclined position. In contrast, the mid section 583 of the rear pivot link 580 is drawn apart from the first stop element 421 when the seating unit is adjusted to the closed position.

The back control link 595 includes a lower end 598 and an upper end 599. The lower end 598 of the back control link 595 is rotatably coupled to the rearward portion 412 of the base plate 410 at pivot 596. The upper end 599 of the back control link 595 is pivotably coupled to the back mounting link 510 at pivot 597. The back-mounting link 510 serves to support a backrest. In embodiments, the back-mounting link 510 is pivotably coupled to the upper end 599 of the back control link 595 at the pivot 597 and is rotatably coupled to the rearward portion 402 of the seat-mounting plate 400 at pivot 511.

Figure 11:
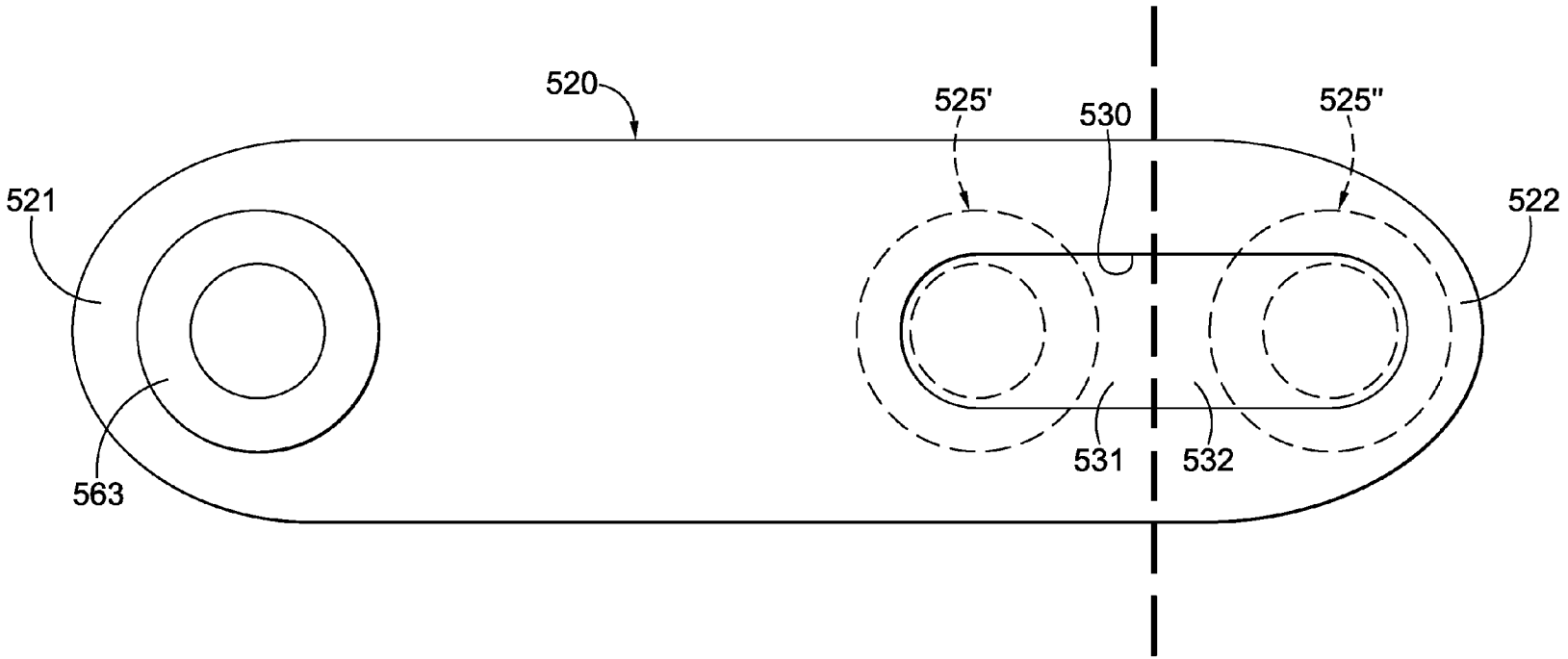
FIG. 11 is a diagrammatic view of an embodiment of a sequence link within the seat-adjustment assembly.

With reference to FIGS. 10 and 11, the sequence link 520 will be described in detail. As discussed above, the first end 521 of the sequence link 520 is pivotably coupled to the lower end 566 of the front bellcrank 560 at the pivot 563. A second end 522 of the sequence link 520 is rotatably coupled to the forward portion 411 of the base plate 410 via an engagement (i.e., rotatable and translatable inter-coupling) of a guide slot 530 and the sequence element 525. That is, the second end 522 of the sequence link 520 includes the guide slot 530 formed therein for rotatably and slidably engaging with the sequence element 525, which is coupled to the base plate 410 at location 526 (see FIG. 7). In embodiments, the sequence element 525, at least partially, extends into the guide slot 530. In a particular instance, the sequence element 525 fully extends through the guide slot 530 and the sequence element 525 includes a cap that retains the sequence link 520 onto the sequence element 525.

In an exemplary embodiment, the sequence element 525 represents a generally cylindrical piece of hardware (e.g., bushing, disc, wheel, and the like) that extends, at least partially, within the guide slot 530. Typically, the guide slot 530 represents a longitudinal, pill-shaped aperture formed (e.g., laser cut or stamped) within the second end 522 of the sequence link 520. In one embodiment, the sequence element 525 is rollably or slidably engaged within the guide slot 530. Although various configurations of the assembly and interplay between the guide slot 530 and the sequence element 525 have been described, it should be understood and appreciated that other types of suitable mechanisms that allow longitudinal shifting of a pivot location between links may be used, and that embodiments of the present invention are not limited to the slot-and-element configuration described herein. For instance, the sequence element 525 and the guide slot 530 may be replaced by a track that guides a roller in a predefined trajectory in order to achieve sequencing of adjustment.

Further, a central, longitudinal axis of the guide slot 530 may be substantially aligned with a central, longitudinal axis of the sequence link 520. In operation, the guide slot 530 acts to guide in a predetermined trajectory and retain the sequence element 525. In a specific instance, as depicted at FIG. 11, the guide slot 530 includes an innermost region 531 and an outermost region 532 that are mutually exclusive (indicated by the dashed vertical line). Generally, the sequence element 525 (shown by 525') resides within the innermost region 531 when the linkage mechanism 100 is adjusted to the closed position or the extended position. In the alternative, the sequence element 525 (shown by 525") resides within the outermost region 532 when the linkage mechanism 100 is adjusted to the reclined position.

Advantageously, the guide slot 530 of the sequence link 520 assists in ensuring that the first phase and the second phase of seating-unit adjustment do not interfere with or overlap each other. For instance, in the closed position of FIG. 8 (when the sequence element 525 resides within the innermost region 531 of the guide slot 530), the interaction of the sequence element 525 and the sequence link 520 resists adjustment of the seating unit directly to the reclined position. In another instance, in the reclined position of FIG. 10 and when the sequence element 525 resides within the outermost region 532 of the guide slot 530, the interaction of the sequence element 525 and the sequence link 520 resists adjustment of the seating unit directly to the reclined position. By integrating this sequencing functionality (between the sequence link 520 and the sequence element 525) into the linkage mechanism 100, the linkage mechanism 100 ensures that adjustment of the footrest between the closed and extended positions is not interrupted by an adjustment of the backrest, and vice versa. In other embodiments a weight of the occupant seated in the seating unit and/or springs (e.g., tension device 350) interconnecting links of the seat-adjustment assembly 500 may assist in producing the sequencing functionality.

Turning to FIGS. 8-10, the operation of the seat-adjustment assembly 500 will now be described. As discussed above, during the first phase of adjustment (moving the seating unit between the closed and extended positions), the footrest assembly 200 extends or collapses while the back-mounting link 510 remains substantially upright, thus, holding the backrest in the inclined orientation. Further, during the first phase, front bellcrank 560 and the rear pivot link 580 rotates in a clockwise direction, causing the seat-mounting plate 400 to translate rearward with respect to the base plate 410 and to recline rearward about the pivot 581. The rearward translation of the seat-mounting plate 400 is impeded upon the mid portion 583 of the rear pivot link 580 contacting the first stop element 421.

The second phase of adjustment (moving the seating unit between the closed and extended positions) may be actuated manually (e.g., the occupant leaning rearward on the backrest) or automatically (e.g., the occupant manipulating an electronic device that controls the linear actuator). With respect to the manual-actuation embodiment, the adjustment to the reclined position (during the second phase of adjustment) is invoked upon the occupant of the seating unit pushing on the backrest, thereby applying a rearward force that rearwardly biases the back-mounting link 510. In one instance, the rearward force should overcome a balance threshold in order to enable movement from the extended position to the reclined position, where the balance threshold is defined by a ratio of the rearward force on the backrest to a downward occupant weight on the seat.

Upon overcoming the balance threshold, the back-mounting link 510 is biased rearwardly about the pivot 511 such that the rearward portion 402 of the seat-mounting plate 400 draws apart from the rear stop element 420. Also, the rearward bias of the back-mounting link 510 pushes the back control link 595 downward at the pivot 597, thus, applying a downward directional force on the rearward portion 412 of the base plate 410 at the pivot 596. Consequently, an upward directional force is generated at the pivot 511 located at the rearward portion 402 of the seat-mounting plate 400. The downward force and the upward force act in cooperation to create separation between the seat-mounting plate 400 and the base plate 410 and, in effect, guide the seat upward while the backrest reclines.

This separation between the seat-mounting plate 400 and the base plate 410 translates the front bellcrank 560 and the rear pivot link 580 upward at the pivots 561 and 581, respectively. The upward translation of the front bellcrank 560 causes clockwise rotation of the sequence link 520 about the sequence element 525 and upward movement of the sequence link 520 with respect to the sequence element 525. In an exemplary embodiment, the upward movement of the sequence link 520 is enabled by the shift of the sequence element 252 from the innermost region 531 (sequence element 525' of FIG. 11) to the outermost region 532 (sequence element 525" of FIG. 11) of the guide slot 530. Further, the upward translation of the front bellcrank 560 lifts the front end 593 of the support link 590 upward at the pivot 562. Concurrently, the upward translation of the rear pivot link 580 lifts the rear end 578 of the connecting link 570 upward at the pivot 574. This lift at the front end 593 of the support link 590 and the rear end 578 of the connecting link 570 cause the support link 590 and the connecting link 570 to rotate upward in a scissor-type motion with a central inter-coupling at the pivot 591. This upward rotation further involves the front end 576 of the connecting link 570 rotating counterclockwise about the pivot 571 (coupled to the base plate 410) and the rear end 594 of the support link 590 rotating clockwise about the pivot 592 (coupled to the base plate 410). This scissor-type motion and, by extension, the adjustment of the seating unit to the reclined position is impeded by the second stop element 572 encountering an upper edge 414 of the aperture 413 formed in the base plate 410.

Adjustment in the second phase from the reclined position to the extended position may be induced by the occupant leaning forward. When the occupant leans forward, the rearward directional force applied to the backrest is relaxed, allowing the weight of the occupant and any springs (e.g., tension device 350) to shift the seat-mounting plate 400 downward toward the base plate 410. This downward shift is controlled by the scissor-type motion of the connecting link 570 in conjunction with the support link 590, as discussed above. Generally, this downward shift coincides with movement of the seat-adjustment assembly 500 that is reverse to the steps discussed above with reference to the recline operation.

It should be understood that the construction of the linkage mechanism 100 lends itself to enable the various links and brackets to be easily assembled and disassembled from the remaining components of the seating unit. Specifically the nature of the pivots and/or mounting locations, allows for use of quick-disconnect hardware, such as a knock-down fastener. Accordingly, rapid disconnection of components prior to shipping, or rapid connection in receipt, is facilitated.

The present invention has been described in relation to particular embodiments, which are intended in all respects to be illustrative rather than restrictive. Alternative embodiments will become apparent to those skilled in the art to which the present invention pertains without departing from its scope.

It will be seen from the foregoing that this invention is one well adapted to attain the ends and objects set forth above, and to attain other advantages, which are obvious and inherent in the device. It will be understood that certain features and subcombinations are of utility and may be employed without reference to other features and subcombinations. This is contemplated by and within the scope of the claims. It will be appreciated by persons skilled in the art that the present invention is not limited to what has been particularly shown and described hereinabove. Rather, all matter herein set forth or shown in the accompanying drawings is to be interpreted as illustrative and not limiting.

What is claimed is:

1. A seating unit, comprising:

a pair of base plates in substantially parallel-spaced relation;

a pair of seat-mounting plates in substantially parallel-spaced relation, wherein each of the seat-mounting plates is disposed in an inclined orientation in relation to each of the base plates, respectively;

a first foot-support ottoman; and a pair of generally mirror-image linkage mechanisms each moveably interconnecting each of the base plates to a respective seat-mounting plate, and adapted to adjust the seating unit between a closed position, an extended position, and a reclined position, wherein each of the linkage mechanisms comprise:

(a) a front bellcrank that is rotatably coupled to a forward portion of a respective seat-mounting plate;

(b) a support link that includes a front end and a rear end, wherein the rear end of the support link is pivotably coupled to a rearward portion of a respective base plate and the front end of the support link is pivotably coupled to the front bellcrank;

(c) a sequence link that is pivotably coupled to the front bellcrank and is rotatably coupled to a forward portion of a respective base plate;

(d) a footrest assembly that movably inter-couples the first foot-support ottoman to a respective seat-mounting plate;

(e) a connecting link having a front end, a mid section, and a rear end; and (f) an ottoman drive link having a front end, a mid section, and a rear end, wherein the front end of the ottoman drive link is pivotably coupled to the footrest assembly, while the rear end of the ottoman drive link is rotatably coupled to the mid section of the connecting link.

2. The seating unit of claim 1, wherein the pivotable coupling of the front bellcrank, the support link, and the sequence link is adapted to incrementally increase the inclined relationship between the seat-mounting plates and the base plates during adjustment of the seating unit from the closed position, the extended position, and the reclined position.

3. The seating unit of claim 1, further comprising a second foot-support ottoman, wherein the footrest assembly movably inter-couples the second foot-support ottoman to a respective seat-mounting plate.

4. The seating unit of claim 1, wherein each of the linkage mechanisms further comprise a rear pivot link having an upper end, a mid section, and a lower end, wherein the upper end of the rear pivot link is pivotably coupled to a rearward portion of a respective seat-mounting plate, while the lower end of the rear pivot link is rotatably coupled to the rear end of the connecting link.

5. The seating unit of claim 4, wherein the connecting link is pivotably coupled to the support link.

6. The seating unit of claim 5, wherein the front end of the connecting link is pivotably coupled to the forward portion of a respective base plate.

7. The seating unit of claim 4, wherein the rearward portion of a respective seat-mounting plate includes a first stop element fixedly attached thereto, and wherein the mid section of the rear pivot link contacts the first stop element when the seating unit is adjusted to the extended position and the reclined position, while the mid section of the rear pivot link is apart from the first stop element when the seating unit is adjusted to the closed position.

8. The seating unit of claim 1, wherein the connecting link includes a second stop element fixedly attached thereto, and wherein the second stop element extends through an aperture formed within a respective base plate.

9. The seating unit of claim 8, wherein the second stop element moves upward within the aperture when adjusting the seating unit to the reclined position, and wherein the second stop element moves downward within the aperture when adjusting the seating unit to the extended position.

10. The seating unit of claim 1, wherein each of the linkage mechanisms further comprise a tension device that spans between a first anchor connection at the mid portion of the ottoman drive link and a second anchor connection at the forward portion of a respective seat-mounting plate.

11. The seating unit of claim 1, wherein each of the linkage mechanisms further comprise a back control link having a lower end and an upper end, and wherein the lower end of the back control link is rotatably coupled to the rearward portion of a respective base plate.

12. The seating unit of claim 11, wherein each of the linkage mechanisms further comprise a back-mounting link that supports a backrest, wherein the back-mounting link is pivotably coupled to the upper end of the back control link and is rotatably coupled to the rearward portion of a respective seat-mounting plate.

13. A seating unit having a seat and at least one ottoman, the seating unit being adapted to move between a closed, an extended, and a reclined position, the seating unit comprising:

a pair of base plates in substantially parallel-spaced relation, wherein the base plates are mounted to one or more legs that are adapted to vertically raise and support the base plates above an underlying surface;

a pair of seat-mounting plates in substantially parallel-spaced relation, wherein the seat-mounting plates translatably carry the seat over the base plates; and a pair of the generally mirror-image linkage mechanisms each moveably interconnecting each of the base plates to a respective seat-mounting plate, and wherein each of the linkage mechanisms include a footrest assembly for extending the at least one ottoman as well as a seat-adjustment assembly comprising:

(a) an ottoman drive link having a front end and a rear end, wherein the front end of the ottoman drive link is pivotably coupled to the footrest assembly;

(b) a connecting link having a front end, a mid section, and a rear end, wherein the mid section of the connecting link is pivotably coupled to the rear end of the ottoman drive link, while the front end of the connecting link is rotatably coupled to a forward portion of a respective base plate;

(c) a rear pivot link having an upper end, a mid section, and a lower end, wherein the upper end of the rear pivot link is pivotably coupled to a rearward portion of a respective seat-mounting plate, while the lower end of the rear pivot link is rotatably coupled to the rear end of the connecting link;

(d) a front bellcrank having an upper end, a mid section, and a lower end, wherein the upper end of the front bellcrank is rotatably coupled to a forward portion of a respective seat-mounting plate; and (e) a support link having a front end, a mid section, and a rear end, wherein the rear end of the support link is pivotably coupled to a rearward portion of a respective base plate, while the front end of the support link is pivotably coupled to the mid section of the front bellcrank.

14. The seating unit of claim 13, wherein the mid section of the connecting link is pivotably coupled to the mid section of the support link.

15. The seating unit of claim 13, wherein the seat-adjustment assembly further comprises a sequence link that is pivotably coupled to the lower end of the front bellcrank and is rotatably coupled to a forward portion of a respective base plate.

16. A linkage mechanism adapted to adjust a recliner seating unit between closed, extended, and reclined positions, the linkage mechanism comprising:

a seat-mounting plate configured to accommodate a seat of the recliner seating unit;

a base plate that includes a forward portion and a rearward portion, wherein a sequence element extends outward from the forward portion of the base plate;

a footrest assembly adapted to extend and retract at least one ottoman when the recliner seating unit is adjusted between the extended and closed positions, respectively; and a seat-adjustment assembly comprising:

(a) a front bellcrank that is rotatably coupled to a forward portion of the seat-mounting plate;

(b) a support link that includes a front end and a rear end, wherein the rear end of the support link is pivotably coupled to a rearward portion of the base plate, while the front end of the support link is pivotably coupled to the front bellcrank;

(c) a sequence link that includes a first end and a second end, wherein the first end is pivotably coupled to the front bellcrank, while the second end includes a guide slot formed therein for rotatably and slidably engaging with the sequence element;

(d) an ottoman drive link having a front end and a rear end, wherein the front end of the ottoman drive link is pivotably coupled to the footrest assembly; and (e) a connecting link having a front end, a mid section, and a rear end, wherein the mid section of the connecting link is pivotably coupled to the rear end of the ottoman drive link, while the front end of the connecting link is rotatably coupled to a forward portion of the base plate.

17. The linkage mechanism of claim 16, wherein the guide slot includes an innermost region and an outermost region that are mutually exclusive, wherein the sequence element resides within the innermost region when the linkage mechanism resides in the closed position and the extended position, and wherein the sequence element resides within the outermost region when the linkage mechanism resides in the reclined position.

* * * * *